US007025697B2

(12) United States Patent
Mizek et al.

(10) Patent No.: US 7,025,697 B2
(45) Date of Patent: Apr. 11, 2006

(54) BLADE STEERING APPARATUS

(75) Inventors: Robert S. Mizek, Downers Grove, IL (US); Miroslav A. Simo, Riverside, IL (US)

(73) Assignee: New Archery Products Corp., Forest Park, IL (US)

( * ) Notice: Subject to any disclaimer, the term of this patent is extended or adjusted under 35 U.S.C. 154(b) by 60 days.

(21) Appl. No.: 10/722,893

(22) Filed: Nov. 26, 2003

(65) Prior Publication Data

US 2005/0124444 A1 Jun. 9, 2005

(51) Int. Cl.
*F42B 6/08* (2006.01)

(52) U.S. Cl. ..... 473/583

(58) Field of Classification Search ..... 473/583, 473/584

See application file for complete search history.

(56) References Cited

U.S. PATENT DOCUMENTS

| | | | |
|---|---|---|---|
| 219,881 | A | 9/1879 | Streeter |
| 2,193,397 | A | 3/1940 | Dykes |
| 2,277,743 | A | 3/1942 | Crossman |
| 2,525,332 | A | 10/1950 | Alger et al. |
| 2,830,818 | A | 4/1958 | Otto |
| 2,887,319 | A | 5/1959 | Lay |
| 2,976,042 | A | 3/1961 | Bamett |
| 3,106,400 | A | 10/1963 | Zwickey |
| 3,539,187 | A | 11/1970 | Smith |
| 3,595,579 | A | 7/1971 | Benolt |
| 3,672,677 | A | 6/1972 | Moore |
| 3,749,403 | A | 7/1973 | Austin et al. |
| 3,756,602 | A | 9/1973 | Carella |
| 3,815,916 | A | 6/1974 | Meszaros |
| D232,356 | S | 8/1974 | Melton |
| 3,897,062 | A | 7/1975 | Christensen |
| 4,003,576 | A | 1/1977 | Carella |
| 4,012,043 | A | 3/1977 | Carella |
| 4,088,323 | A | 5/1978 | Munger |
| 4,203,601 | A | 5/1980 | Simo |
| 4,204,307 | A | 5/1980 | Pfetzing |
| 4,234,192 | A | 11/1980 | Salamone |
| 4,381,866 | A | 5/1983 | Simo |
| 4,392,654 | A | 7/1983 | Carella |
| 4,477,084 | A | 10/1984 | Austin |
| 4,488,728 | A | 12/1984 | Humphrey |
| 4,502,692 | A | 3/1985 | Humphrey |
| 4,510,109 | A | 4/1985 | Carella |
| 4,534,568 | A | 8/1985 | Tone |

(Continued)

FOREIGN PATENT DOCUMENTS

JP 2003-21499 1/2003

OTHER PUBLICATIONS

Borehead Broadhead™, *Bowhunting World* (Feb. 28, 1990), *Revolutionary New Tips Now Available in SIX Models*. Advertisement by Hunting Innovations, Royersford, PA (Feb. 28, 1990) (2 pages).

Bowhunting World, *Borehead Broadheads*, 3 paragraphs–article (Feb. 1990) (2 pages).

Exhitbit A, 9 digital photographs of a 3–blade and a 2–blade arrowhead, each corresponding to the BOREHEAD BROADHEAD™ arrowhead, on sale at least as early as 1995 (9 pages).

*Primary Examiner*—John A. Ricci
(74) *Attorney, Agent, or Firm*—Pauley Petersen & Erickson

(57) ABSTRACT

A steering element for a blade which is preferably mounted with respect to or part of an arrowhead or broadhead. During flight, a leading surface of the steering element contacts with airflow. One or more force components act in a direction generally perpendicular to a flat surface of the blade, to impart rotation or spin of a body of the arrowhead about a longitudinal axis of the arrowhead.

20 Claims, 4 Drawing Sheets

4,565,377 A 1/1986 Troncoso, Jr. et al.
4,583,745 A 4/1986 Ladner
4,615,552 A 10/1986 Bengtson
4,676,512 A 6/1987 Simo
4,986,550 A 1/1991 Segovia
5,039,110 A 8/1991 Honda
5,064,202 A 11/1991 Barner
5,213,090 A 5/1993 Tone
5,257,809 A 11/1993 Carrizosa
5,427,385 A 6/1995 Conrad et al.
5,439,231 A 8/1995 Roberts et al.
5,443,273 A 8/1995 Lovorn
5,465,981 A 11/1995 Klaus
5,613,688 A 3/1997 Carella
5,846,147 A 12/1998 Basik
5,871,410 A 2/1999 Simo et al.
5,897,449 A 4/1999 Roberts et al.
5,951,419 A 9/1999 Camaneti
6,142,896 A 11/2000 Simo et al.
6,203,457 B1 3/2001 Snook
6,319,161 B1 11/2001 Martinez et al.
6,398,676 B1 6/2002 Mizek
6,663,518 B1 12/2003 Kuhn
2002/0151394 A1 10/2002 Arasmith
2004/0074483 A1 4/2004 Kuhn

BLADE STEERING APPARATUS

BACKGROUND OF THE INVENTION

1. Field of the Invention

This invention relates to an apparatus for steering a blade, for example a blade of an arrowhead, to impart rotation of the blade about a longitudinal axis.

2. Discussion of Related Art

Conventional blades, particularly for arrowheads, are relatively straight and often have a flat surface. Many conventional arrowhead blades are mounted so that the blade is parallel to a longitudinal axis of an arrow shaft, for example when the arrowhead is mounted to the arrow shaft. The parallel arrangement and the flat surface of the blade cause many conventional arrows and arrowheads to have a flight path where the arrow shaft either does not spin or spins relatively little. However, in order to achieve aerodynamic stabilization during flight, it is desirable to have a spinning arrow shaft.

Some conventional arrowheads have a blade that is positioned or mounted at an angle with respect to the longitudinal axis of the arrow shaft, to impart spin or rotation upon the arrow shaft. The angled arrangement causes many manufacturing problems and difficulties.

Other conventional arrowheads have curved blades that act as an airfoil to impart rotation or spin upon the arrow shaft. For example, the CRIMSON TALON™ broadhead, as offered by 2XJ Enterprises, Inc., North East, Md., USA, has a curved blade design that forms an airfoil for rotating or spinning the arrow shaft. The curved arrangement causes many problems and difficulties.

There is an apparent need for a blade, for example for an arrowhead or a broadhead, that is relatively inexpensive to manufacture and easy to assemble, wherein wind forces during flight act upon and cause the arrowhead and thus the arrow shaft to rotate or spin.

SUMMARY OF THE INVENTION

It is one object of this invention to provide a relatively inexpensive blade that can be easily manufactured and installed, for example, in an arrowhead or broadhead.

It is another object of this invention to provide a blade with a steering element that can be used to impart rotation or spin upon an arrowhead and/or an arrow shaft.

The above and other objects of this invention are accomplished with a blade that has a steering element connected to the blade and/or integrated with the blade. The steering element is preferably positioned and designed so that during a flight of the blade, air flows over the steering element and transfers a force or forces that move the blade in a direction generally perpendicular to a blade surface. When used on an arrowhead or broadhead, the steering element causes the arrowhead to rotate or spin which thus causes the arrow shaft to rotate or spin. Spinning an arrow shaft about its longitudinal axis during a flight of the arrow aerodynamically stabilizes the flight of the arrow.

The steering element of this invention projects or extends outward from a surface, preferably but not necessarily a flat surface, of the blade. The steering element can be integrated with the blade and/or can be connected to the blade.

The blade of this invention can be used with an arrowhead or broadhead as previously discussed, or can be used with any other device or apparatus that accepts a blade. The blade of this invention can be fixed to a body of the arrowhead, can be connected to the body of the arrowhead and/or can be mechanically movable with respect to the body of the arrowhead.

BRIEF DESCRIPTION OF THE DRAWINGS

The above and other features of this invention can be understood when the specification is read in view of the drawings, wherein.

DETAILED DESCRIPTION OF PREFERRED EMBODIMENTS

Figure 1:
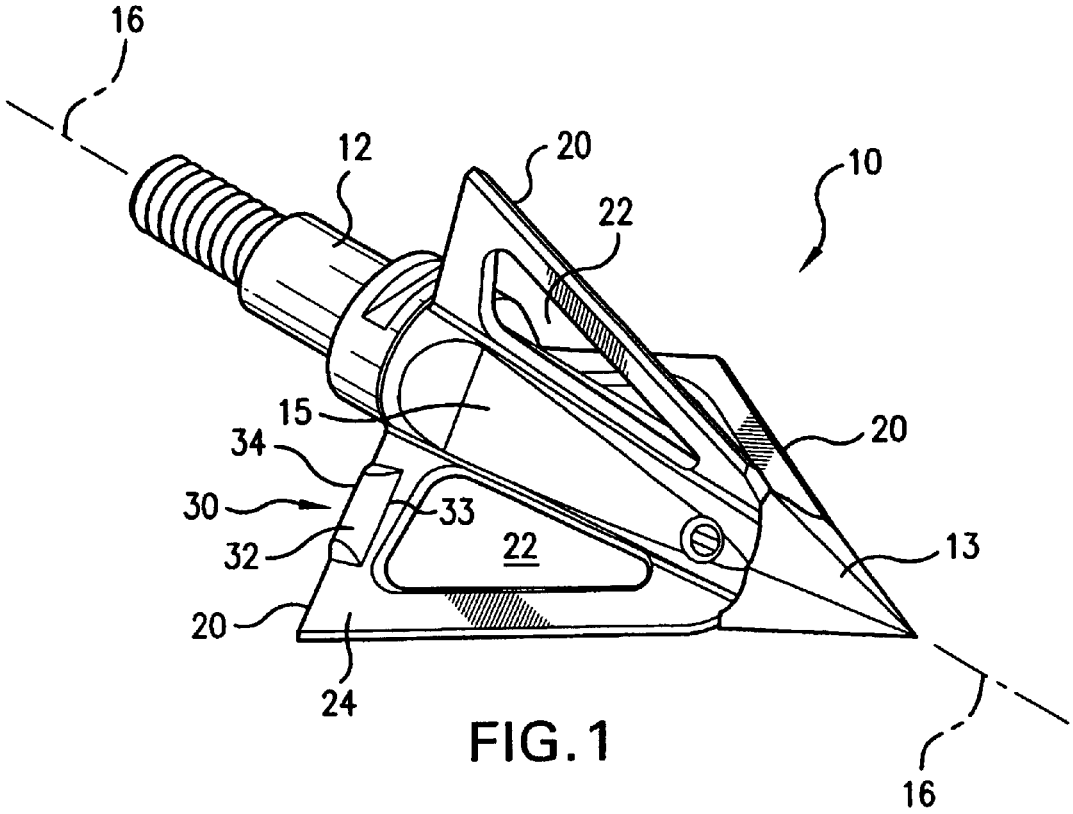
FIG. 1 is a perspective view of an arrowhead, according to one preferred embodiment of this invention.

FIG. 1 shows a perspective view of arrowhead or broadhead 10, according to one embodiment of this invention. As used throughout this specification and in the claims, the term arrowhead is intended to be interchangeable with the term broadhead, which relates to an arrowhead having two or more blade surfaces formed by one or more blades, each of which is fixed with respect to, connected with respect to and/or mechanically movable with respect to shaft 12 and/or body 15 of arrowhead 10.

Tip 13 is integrated with and/or connected to ferrule or body 15 of arrowhead 10. Many conventional arrowhead tips are known to those skilled in the art of arrowhead design and can be interchanged with tip 13 as shown in FIG. 1.

At least two blades 20 are attached with respect to body 15 of arrowhead 10. As shown in FIG. 1, three blades 20 are removably fixed with respect to body 15. In other embodiments of this invention, blade 20 can be integrated with body 15, to form a cartridge type arrowhead. In still other embodiments of this invention, blade 20 can be movable, such as pivotable, with respect to body 15 and/or shaft 12. In one embodiment of this invention, each blade 20 and/or body 15 can rotate with respect to shaft 12.

Figure 5:
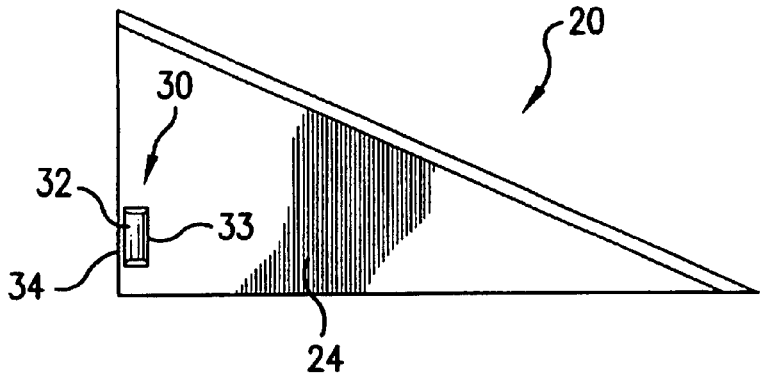
FIG. 5 is a side view of a blade with a steering element, according to one embodiment of this invention.
Figure 6:
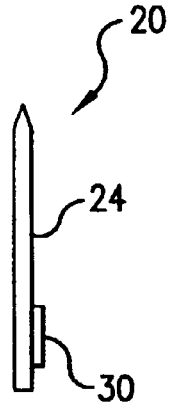
FIG. 6 is a rear view of the blade with the steering element, as shown in FIG. 5.
Figure 7:
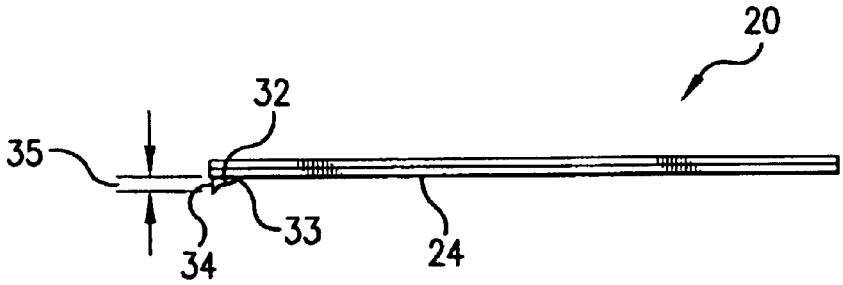
FIG. 7 is a top view of the blade with the steering element, as shown in FIG. 5.
Figure 8:
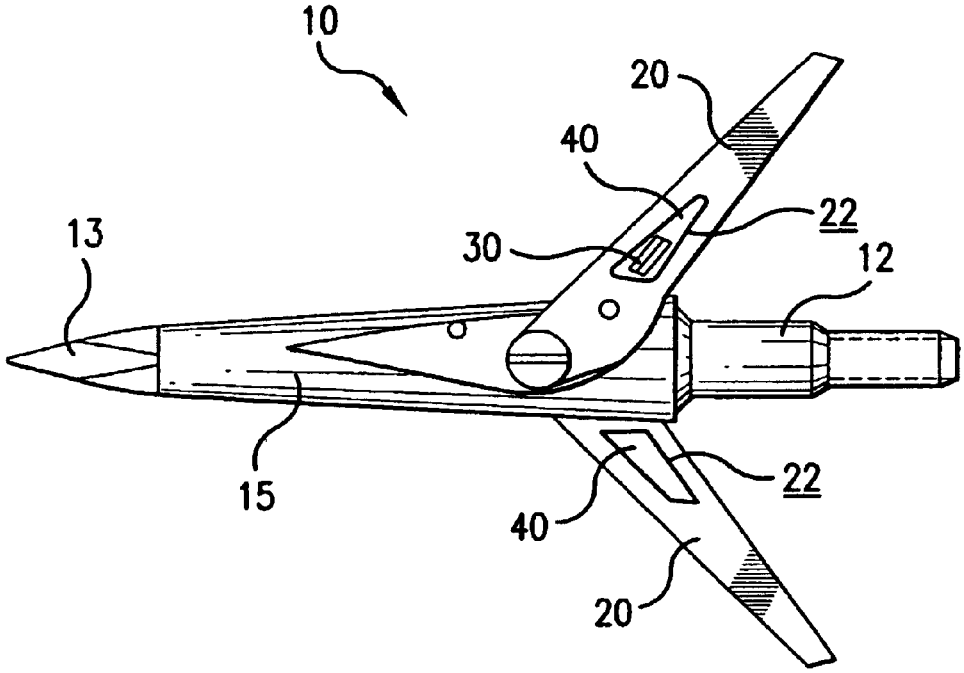
FIG. 8 is a side view of an arrowhead, according to one preferred embodiment of this invention.

Blade 20 can have an overall triangular shape or any other suitable shape. As shown in FIG. 1, blade 20 has cutout 22. Blade 20 can also have more than one cutout 22, or as shown in FIGS. 5–7 can be solid with no cutout 22.

In one embodiment of this invention, each blade 20 has flat surface 24 which is relatively inexpensive to manufacture and is easy to handle. Flat surface 24 also forms a relatively straight blade 20 that can be easily installed with respect to body 15. Also, straight blades 20 are safe to handle, particularly when installing blade 20 with respect to body 15.

As shown in FIGS. 1–7, each blade 20 has one steering element 30. Although not shown in the drawings, any blade 20 can have two or more steering elements 30, which can be positioned relatively close to each other or which can be positioned apart from each other.

Each steering element 30 acts as an aielron, a spoiler, a rudder, a trim tab and/or a kicker element, and throughout this specification and in the claims, these terms are intended to be interchanged with each other.

As shown in FIGS. 1–7, steering element 30 has a shape of a vane. However, steering element 30 can be any other structure that extends outward from flat surface 24. For example, steering element 30 can be a protuberance or other structure raised with respect to flat surface 24 of blade 20.

Steering element 30 can be integrated with blade 20 and/or can be attached or connected to blade 20. For example, steering element 30 can be welded, adhered or otherwise secured with respect to blade 20. Steering element 30 of this invention can be attached or connected to an existing or conventional blade or arrowhead.

As shown in FIGS. 5–7, steering element 30 has leading surface 32 that contacts air flow during flight of arrowhead 10. In one embodiment, front 33 of leading surface 32 forms a leading edge that preferably but not necessarily is flush with flat surface 24 of blade 20. Although a completely flush structure provides very good aerodynamic properties, front 33 can be positioned at a distance from flat surface 24, preferably a relatively small distance, and may have only minimal effects upon aerodynamics when air flows against leading surface 32.

Also shown in FIGS. 5–7, in one embodiment of this invention, distance 35 between leading surface 32 and flat surface 24 increases in a direction from front 33 to rear 34 of leading surface 32. Leading surface 32 can be flat, planar or curved. For example, as shown in FIG. 7, at least a portion of leading surface 32 is concave. Leading surface 32 can also have a flat portion and a curved portion.

During flight of arrowhead 10, air flows against leading surface 32 and thus the air flow transfers at least one force component acting generally perpendicular to flat surface 24. The generally perpendicular forces act upon blade 20 which is mechanically or structurally connected to body 15 and thus spins or rotates body 13 about longitudinal axis 16.

Steering element 30 of this invention can have any suitable shape and/or size that results in rotation or spin of body 15 about longitudinal axis 16. Although FIGS. 1–7 show each blade 20 having steering element 30 on only one side of blade 20, blade 20 can have one or more steering elements on both sides of blade 20 and as long as the summation of areas of leading surfaces 32 on one side is greater than the summation of areas of leading surfaces 32 on the other side, then body 15 will still rotate or spin about longitudinal axis 16 during flight of arrowhead 10.

Figure 2:
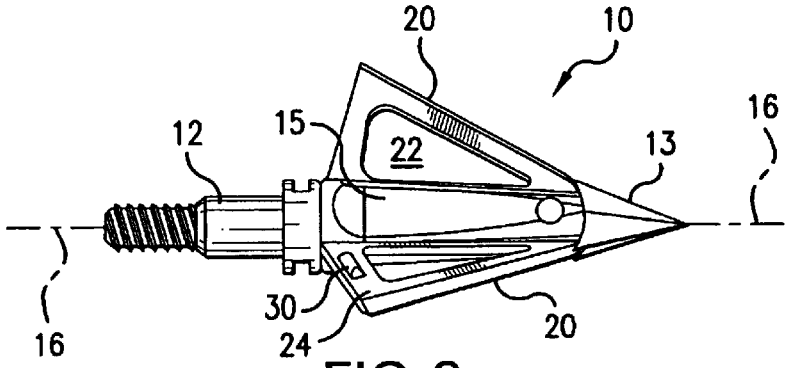
FIG. 2 is a side view of the arrowhead, as shown in FIG. 1.
Figure 3:
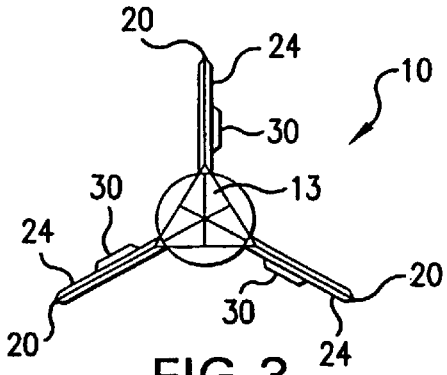
FIG. 3 is a front view of the arrowhead, as shown in FIG. 1.
Figure 4:
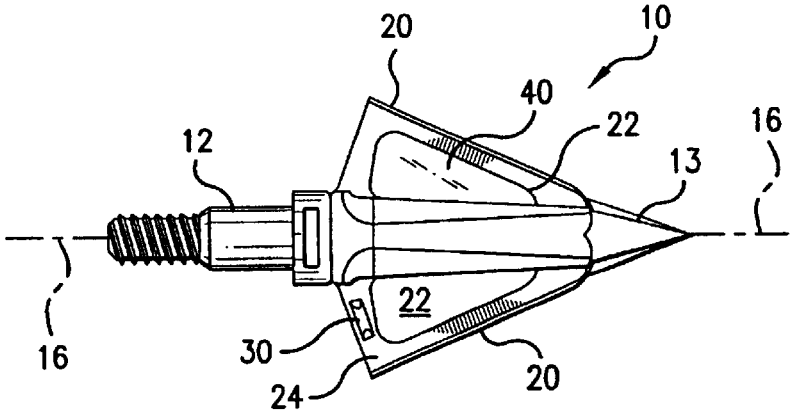
FIG. 4 is top view of the arrowhead, as shown in FIG. 1.

Steering element 30 of this invention can be marketed as an add-on element to an existing or conventional arrowhead, broadhead or arrowhead blade. For example, FIGS. 1, 2 and 4 show an embodiment where blade 20 has one cutout 22. Blade 20 can also have two or more cutouts 22. Any one or more cutouts 22 of blade 20 can be filled with an insert 40, as shown in FIG. 4, preferably but not necessarily a relatively flat insert, and steering element 30 can be attached to, connected to, secured to and/or integrated with the insert. In another embodiment, the insert itself, either partially or in its entirety, can be formed as steering element 30 and can be connected or otherwise attached to blade 20.

In another embodiment, steering element 30 can be connected or attached to an edge portion of blade 20. For example, a U-shaped clip or other clamping device can be used to connect steering element 30 to or with respect to blade 20. Although a clip or other clamping device may result in front 33 of blade 20 not meeting flush with flat surface 24, the aerodynamic performance loss may be small enough to allow the cost savings and convenience associated with the simple attachment.

In still another embodiment of this invention, steering element 30 can be attached to, connected to or secured to blade 20 with an adhesive. For example, a double-sided adhesive can be positioned between flat surface 24 and a bottom surface of steering element 30. In one embodiment of this invention, the double-sided adhesive can be applied to a relatively long run of steering element 30, such as in an extruded form, and then can be cut into segments of desired lengths.

While in the foregoing specification this invention has been described in relation to certain preferred embodiments thereof, and many details have been set forth for purpose of illustration, it will be apparent to those skilled in the art that the invention is susceptible to additional embodiments and that certain of the details described herein can be varied considerably without departing from the basic principles of the invention.

What is claimed is:

1. An arrowhead comprising;

at least two blades attached with respect to a body of the arrowhead, each of said blades having a flat surface on at least one face of one of said blade and an insert mounted within a cutout of said blade, and a steering element extending outward from said flat surface.

2. An arrowhead according to claim 1, wherein said steering element has a leading surface, and a distance between said leading surface and said flat surface of said blade increases in a direction from a front of said leading surface to a rear of said leading surface.

3. An arrowhead according to claim 2, wherein said leading surface is flat.

4. An arrowhead according to claim 2, wherein said leading surface is curved.

5. An arrowhead according to claim 2, wherein at least a portion of said leading surface is concave.

6. An arrowhead according to claim 1, wherein said steering element is integrated with said blade.

7. An arrowhead according to claim 1, wherein said steering element is connected to said blade.

8. An arrowhead according to claim 1, wherein said flat surface is planar.

9. An arrowhead according to claim 1, wherein each said blade is removably attached to said body.

10. An arrowhead according to claim 1 wherein each said blade is pivotably mounted with respect to said body.

11. A blade for an arrowhead, the blade comprising:

a flat surface on at least one face of one of said blade and an insert mounted within a cutout of said blade, and a steering element extending outward from said flat surface.

12. A blade according to claim 11, wherein said steering element has a leading surface, and a distance between said leading surface and said flat surface of said blade increases in a direction from a front of said leading surface to a rear of said leading surface.

13. A blade according to claim 12, wherein said leading surface is flat.

14. A blade according to claim 12, wherein said leading surface is curved.

15. A blade according to claim 12, wherein at least a portion of said leading surface is concave.

16. A blade according to claim 11, wherein said steering element is integrated with said blade.

17. A blade according to claim 11, wherein said steering element is connected to said blade.

18. A blade according to claim; 11, wherein said flat surface is planar.

19. A blade according to claim 11, wherein a layer of adhesive is positioned between said flat surface and a bottom surface of said steering element.

20. A blade according to claim 11, wherein said blade is pivotally attached with respect to a body of an arrowhead.

* * * * *